US012516890B2

(12) United States Patent
Xiong et al.

(10) Patent No.: US 12,516,890 B2
(45) Date of Patent: Jan. 6, 2026

(54) COMBINATION HEAT DISSIPATION STRUCTURE

(71) Applicant: ASIA VITAL COMPONENTS (CHINA) CO., LTD., Shenzhen (CN)

(72) Inventors: Xiwen Xiong, Shenzhen (CN); Xingxing Lyu, Shenzhen (CN); Wei Liu, Shenzhen (CN); Lei Yao, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 134 days.

(21) Appl. No.: 18/387,854

(22) Filed: Nov. 8, 2023

(65) Prior Publication Data

US 2025/0146762 A1 May 8, 2025

(51) Int. Cl.
*F28D 15/04* (2006.01)

(52) U.S. Cl.
CPC ..... *F28D 15/04* (2013.01)

(58) Field of Classification Search
CPC .... F28D 15/04; F28D 15/046; F28D 15/0275; F28D 15/0266; H05K 7/20336; F28F 2215/06
See application file for complete search history.

(56) References Cited

U.S. PATENT DOCUMENTS 6,738,257 B1 * 5/2004 Lai ..... F28F 1/32 174/15.2
10,077,946 B2 * 9/2018 Sun ..... B23K 1/18
2007/0272399 A1 * 11/2007 Nitta ..... F28D 15/046 165/185
2009/0260785 A1 * 10/2009 Wang ..... F28D 15/046 165/170

(Continued)

FOREIGN PATENT DOCUMENTS

CN 215337895 U 12/2021
CN 215529697 U 1/2022

(Continued)

OTHER PUBLICATIONS

Search Report dated Apr. 29, 2024 issued by Taiwan Intellectual Property Office for counterpart application No. 112140197.

*Primary Examiner* — Tho V Duong
(74) *Attorney, Agent, or Firm* — Demian K. Jackson; Jackson IPG PLLC

(57) ABSTRACT

A combination heat dissipation structure includes a vapor chamber and at least one heat pipe. The vapor chamber defines an airtight chamber filled with a working fluid and provided with first and second wick structures. The vapor chamber further includes at least one through hole formed on its upper wall and communicable with the airtight chamber, and at least one annular element provided in the airtight chamber corresponding to the through hole to contact with the first and second wick structures. The heat pipe has an (Continued)

open end inserted into the airtight chamber to contact with the first wick structure, such that the heat pipe is axially supported and located by the annular element. With these arrangements, a flow-back path between the vapor chamber and the heat pipe is largely shortened to avoid dry burning in the vapor chamber and upgrade the two-phase heat exchange efficiency of the vapor chamber.

11 Claims, 4 Drawing Sheets

(56) References Cited

U.S. PATENT DOCUMENTS

| | | | | |
|---|---|---|---|---|
| 2010/0108297 | A1* | 5/2010 | Chen | F28D 15/0233 29/890.032 |
| 2011/0008198 | A1* | 1/2011 | Hou | H01L 21/4871 419/6 |
| 2017/0312871 | A1* | 11/2017 | Lin | B23P 15/26 |

FOREIGN PATENT DOCUMENTS

| | | | |
|---|---|---|---|
| CN | 114963824 | A | 8/2022 |
| TW | M650912 | | 1/2024 |

* cited by examiner

COMBINATION HEAT DISSIPATION STRUCTURE

FIELD OF THE INVENTION

The present invention relates to a combination heat dissipation structure, and more particularly, to a combination heat dissipation structure that has enhanced structural strength and allows a working fluid to flow back from a condensing zone to a vaporizing zone more efficiently.

BACKGROUND OF THE INVENTION

To satisfy customers' increasing demands for good heat dissipation of electronic devices, such as computers or servers, a three-dimensional (3D) vapor chamber (VC) structure has been developed. Compared to a conventional two-dimensional (2D) vapor chamber, the 3D vapor chamber advantageously has higher density of integration, higher vapor diffusion rate, smaller thermal resistance, and higher upper limit of heat dissipation. In view of the constantly increased density of integration of chips in the electronic devices and the increasing requirement for heat dissipation, the conventional heat pipe and/or vapor chamber can no longer suffice the heat dissipation requirement for the high heat flux electronics, the 3D vapor chamber has been widely applied in the field of electronic device heat dissipation and gradually replaces the heat pipe and/or the vapor chamber that are used individually.

Please refer to FIG. 1 that is a cross-sectional view of a conventional 3D vapor chamber structure 1. As shown, the conventional 3D vapor chamber structure 1 consists of a plurality of pipes 11 and a vapor chamber 12. The vapor chamber 12 includes an upper plate member 121 and a lower plane member 122, which are closed to each other to define a flat chamber 124 between them. The flat chamber 124 has a working fluid (not shown) filled therein. The upper plate member 121 is provided with at least one opening 123, which extends through the upper plate member 121 to communicate with the flat chamber 124. The opening 123 has a rim that extends upward to form a ring portion 123*a*. A first wick structure 125 and a second wick structure 126 are provided on an inner wall surface of the upper and the lower plate member 121, 122, respectively. And, a plurality of supporting members 127 is provided in the flat chamber 124 to support and space the upper and the lower plate member 121, 122 from one another. The supporting members 127 and the openings 123 are arranged in a staggered manner to space from one another.

The pipe 11 has two ends, one of which is a closed end 111 and the other is an open end 112. The pipe 11 internally defines a tubular chamber 114 between the closed end 111 and the open end 112. The open end 112 of the pipe 11 is inserted through the opening 123 to connect with the upper plate member 121; and a joint between the ring portion 123*a* of the opening 123 on the upper plate member 121 and the open end 112 of the pipe 11 is fixedly connected together by welding. The tubular chamber 114 in the pipe 11 is communicable with the flat chamber 124 via the open end 112 of the pipe 11. And, a third wick structure 115 is provided on an inner wall surface of the tubular chamber 114.

The third wick structure 115 in the pipe 11 can be distributed to contact with or without contacting with the first wick structure 125 in the vapor chamber 12 on the inner wall surface of the upper plate member 121.

The working fluid condensed in the pipe 11 can flow back from the closed end 111 to a vaporizing zone in the vapor chamber 12 in two ways. In the first way, the condensed working fluid in the pipe 11 flows through the open end 112 of the pipe 11 to the first wick structure 125 nearby the opening 123 on the upper plate member 121 and is then collected at the first wick structure 125. When the collected working fluid reaches a predetermined volume, it drops into the vaporizing zone due to gravity. In the second way, the working fluid flows back to places near the opening 123 and is diffused horizontally with the aid of the first wick structure 125. When the diffused working fluid meets the supporting members 127, it flows downward along outer surfaces of the supporting members 127 and reaches at the second wick structure 126, from where the working fluid flows back to the vaporizing zone in the vapor chamber 12. Since the supporting members 127 are respectively located at a distance from the opening 123, the working fluid has to flow through a considerably long path before it reaches at the vaporizing zone, resulting in low flow-back efficiency. In the case the time and the path for the working fluid to flow back to the vaporizing zone are very long and the working fluid could not flow back to the vaporizing zone in time, the vaporizing zone tends to occur dry burning due to insufficient working fluid therein.

Further, the pipe 11 and the vapor chamber 12 are horizontally fixedly welded to each other only at the joint between the ring portion 123*a* and the open end 112. That is, the pipe 11 and the vapor chamber 12 only has a line contact formed between them. The pipe 11 extended into the flat chamber 124 in the vapor chamber 12 is not vertically supported or held in place by any structure. When the pipe 11 is subjected to a vertical impact, or when the closed end 111 of the pipe 11 has radiation fins mounted thereon, it is very possible that the pipe 11 would separate from the vapor chamber 12 or become bent or even broken to cause leakage of the working fluid from the conventional 3D vapor chamber 1 structure. The above problems in the conventional 3D vapor chamber structure 1 must be solved as soon as possible.

SUMMARY OF THE INVENTION

To effectively solve the problems in the prior art, it is a primary object of the present invention to provide a combination heat dissipation structure consisting of a vapor chamber and at least one heat pipe. The assembled vapor chamber and heat pipe has enhanced overall structural strength and allows a condensed working fluid to flow from the heat pipe back to the vapor chamber more efficiently.

To achieve the above and other objects, the combination heat dissipation structure according to the present invention includes a vapor chamber and at least one heat pipe.

The vapor chamber internally defines an airtight chamber filled with a working fluid. The vapor chamber is formed of an upper plate member and a lower plate member, which are closed to each other to define the airtight chamber between them. Two opposing inner side surfaces of the upper and the lower plate member that face toward the airtight chamber are provided with a first and a second wick structure, respectively.

The upper plate member of the vapor chamber is provided with at least one through hole, which is communicable with the airtight chamber. The airtight chamber has at least one annular element provided therein. The annular element is a porous structure and has an upper end surface and a lower end surface, which are in contact with the first and the second wick structure, respectively. Further, the annular element is located corresponding to the through hole.

The heat pipe has two ends, one of which is a closed end and the other is an open end. The heat pipe internally defines a heat pipe chamber extended between the closed and the open end to communicate with the airtight chamber via the open end. That is, the open end of the heat pipe is inserted into the through hole on the upper plate member of the vapor chamber to enter the airtight chamber and contact with the first wick structure. The open end of the heat pipe inserted into the airtight chamber is axially supported and located by the annular element located beneath the wick structure corresponding to the through hole.

According to the present invention, each through hole on the vapor chamber has one annular element located corresponding to it. The annular element not only provides an axial supporting and locating to the heat pipe inserted into the airtight chamber, but also allows the working fluid condensed in the heat pipe chamber to pass it and directly and quickly flow back to a vaporizing zone in the vapor chamber. Therefore, it is able to solve the problems that the prior art 3D vapor chamber structure has a relative weak structural strength and an overly long flow-back path that tends to cause dry burning in the vapor chamber.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
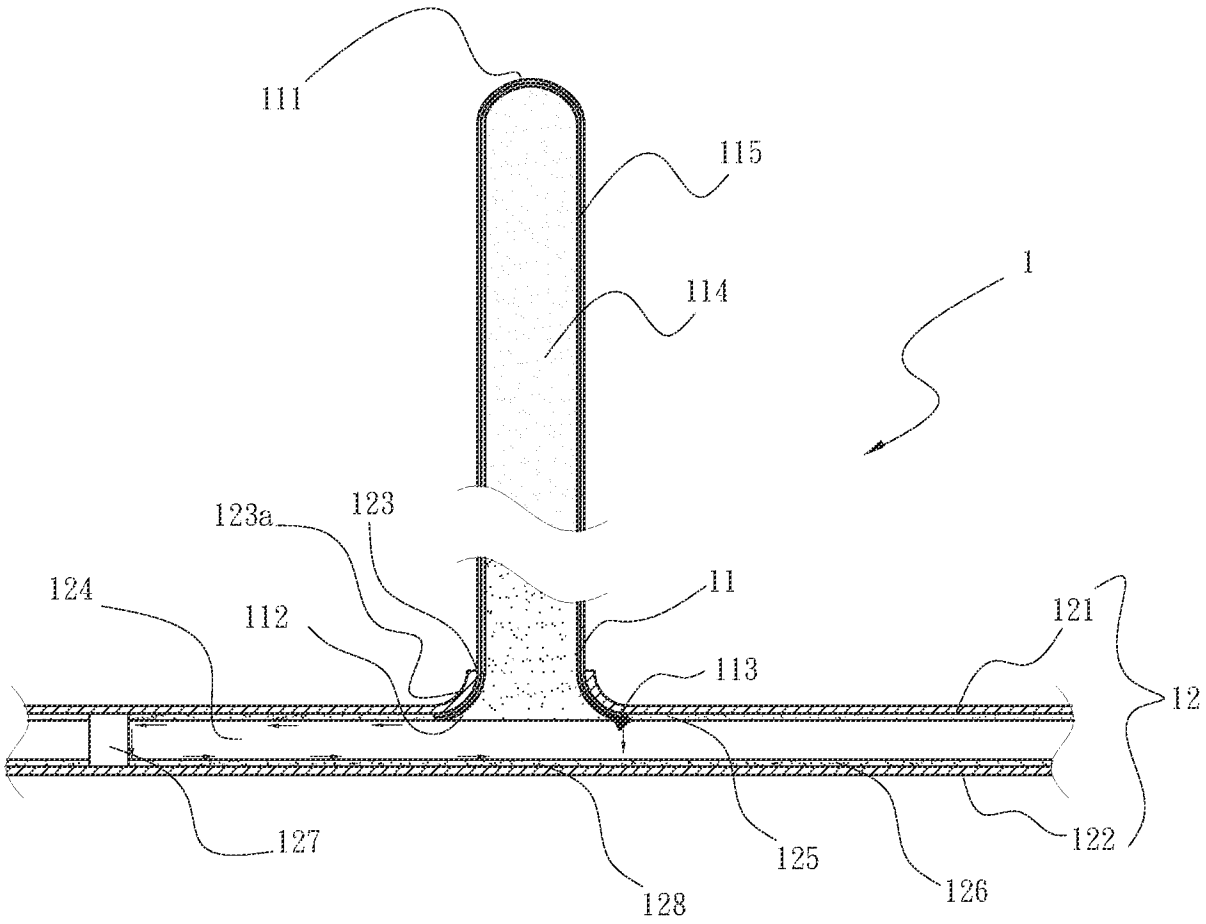
(PRIOR ART) Fig. 1
FIG. 1 is a cross-sectional view of a conventional three-dimensional (3D) vapor chamber structure.

The present invention will now be described with some preferred embodiments thereof. For the purpose of easy to understand, elements that are the same in the preferred embodiments are denoted by the same reference numerals.

Figure 2:
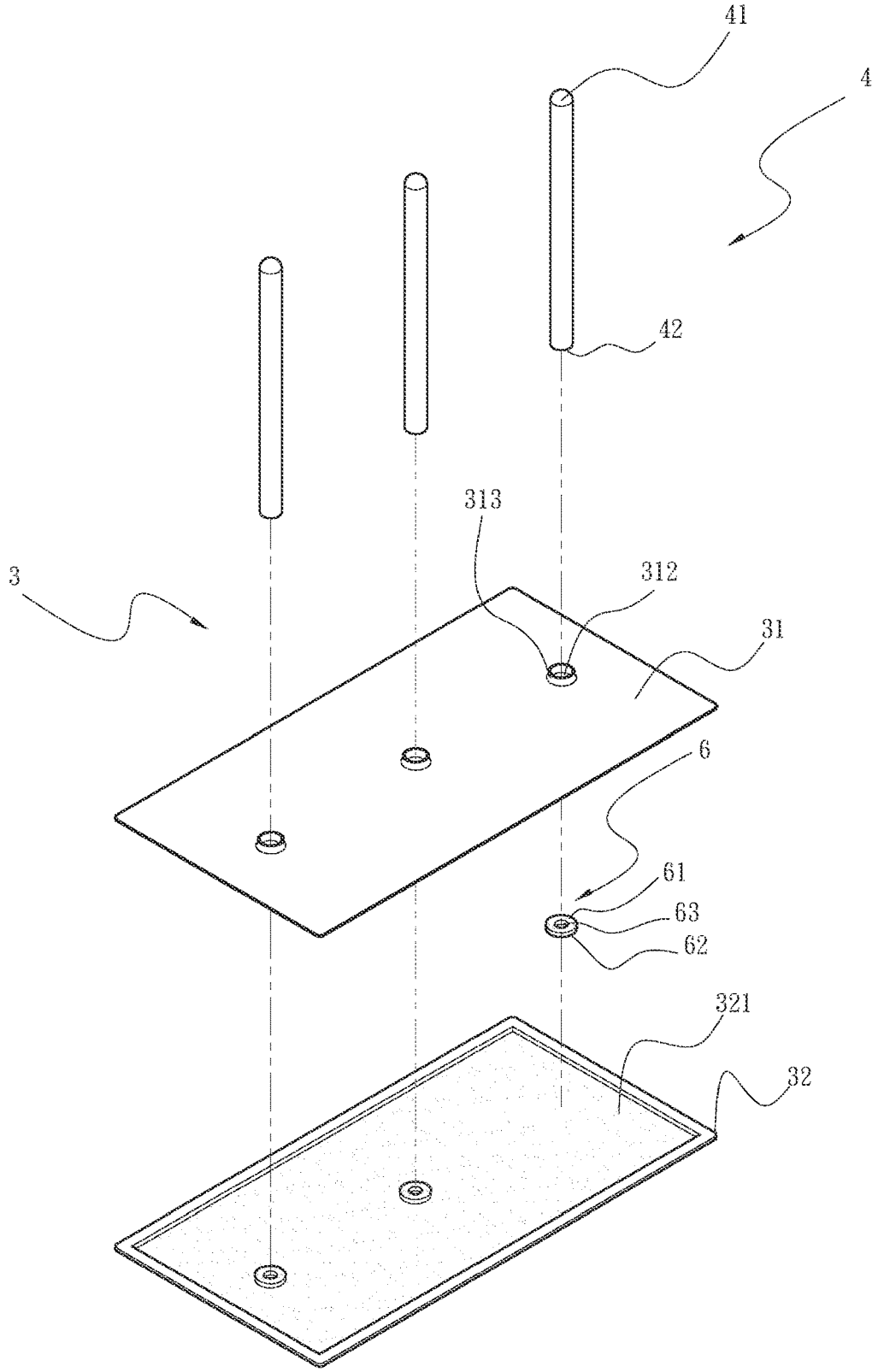
FIG. 2 is an exploded perspective view of a combination heat dissipation structure according to a preferred embodiment of the present invention.
Figure 3:
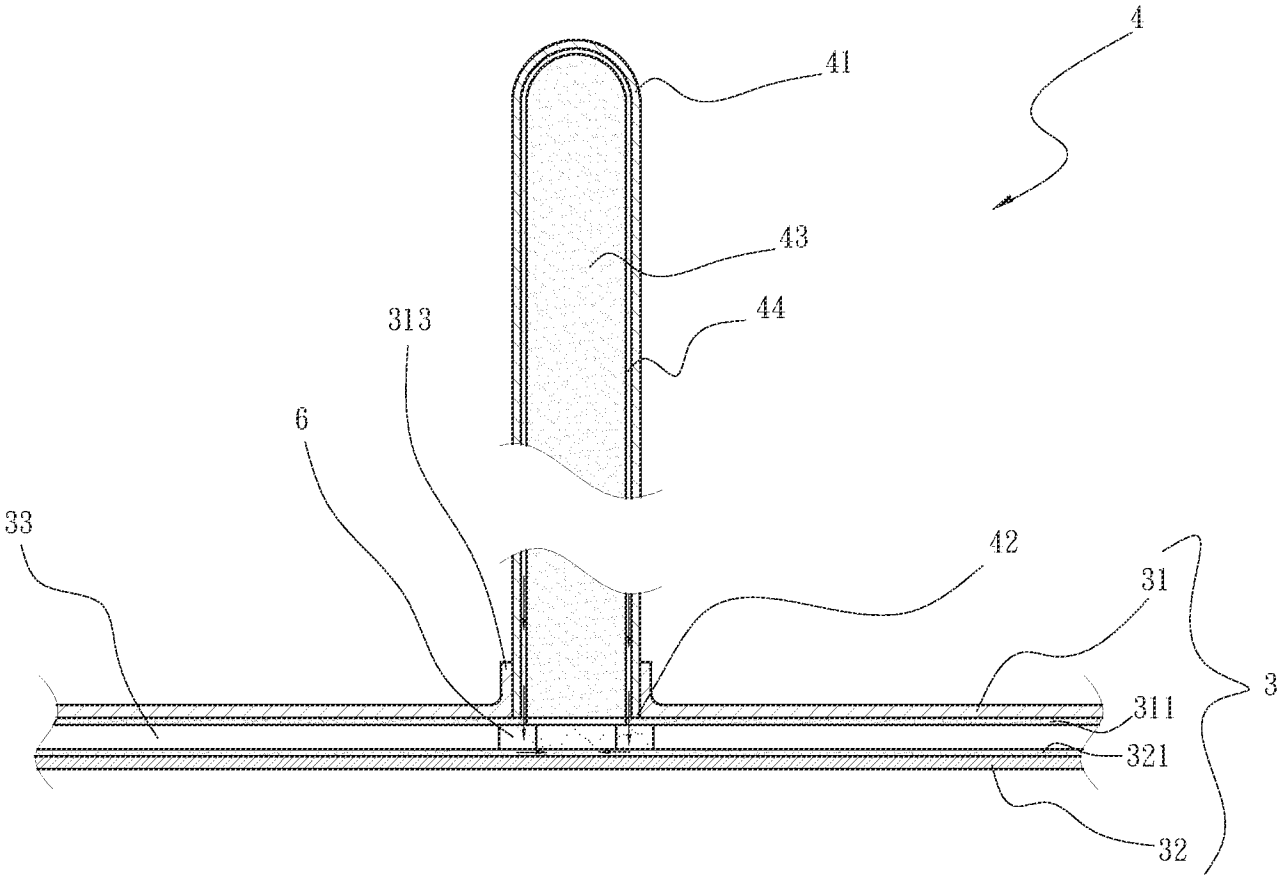
FIG. 3 is an assembled cross-sectional view of the combination heat dissipation structure of FIG. 2.
Figure 4:
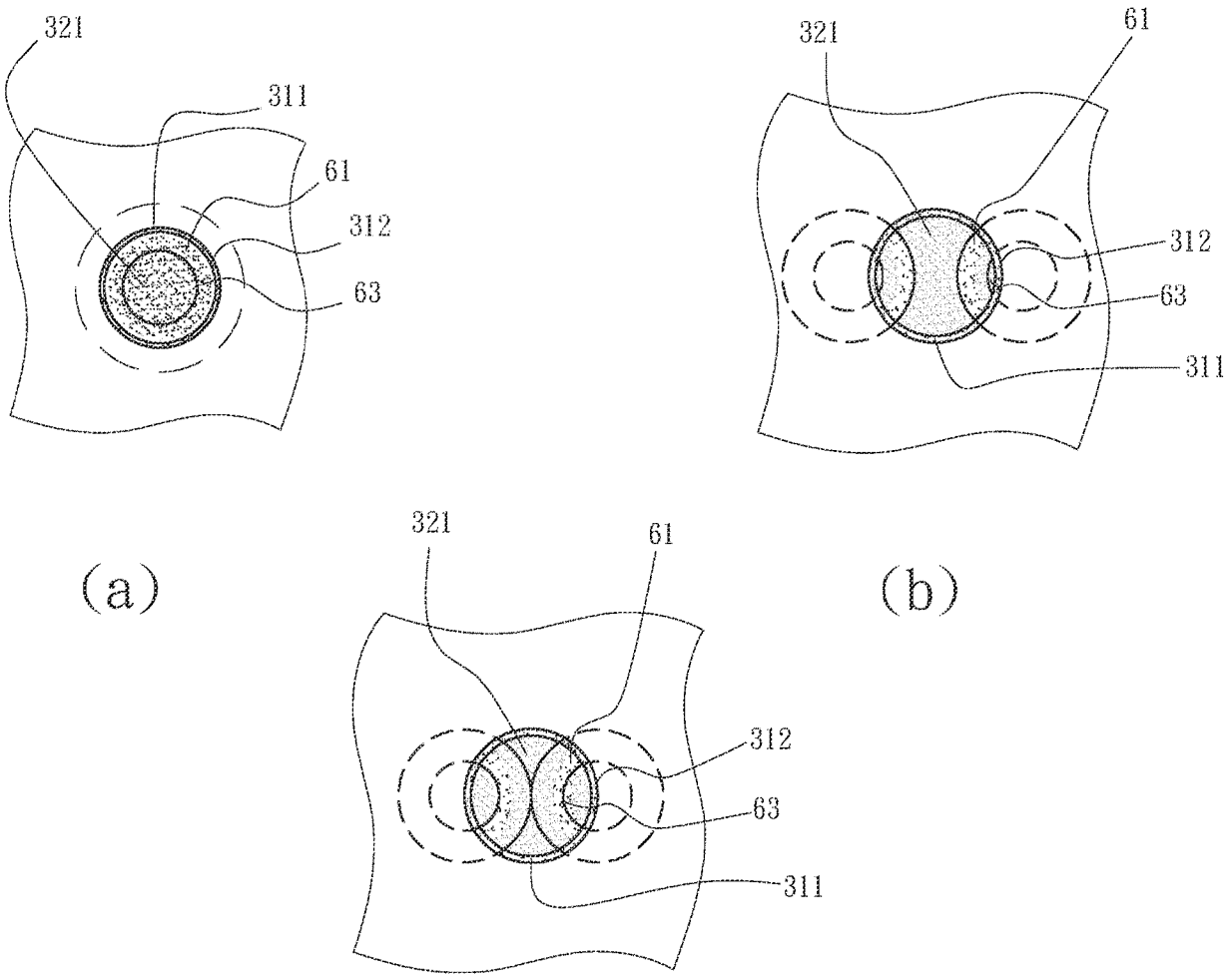
FIG. 4*a* is a top view of the combination heat dissipation structure of FIG. 2.
FIG. 4*b* is a top view of a first variant of the combination heat dissipation structure of FIG. 2.
FIG. 4*c* is a top view of a second variant of the combination heat dissipation structure of FIG. 2.

Please refer to FIGS. 2, 3, and 4*a*, which are exploded perspective view, assembled cross-sectional view and top view, respectively, of a combination heat dissipation structure according to a preferred embodiment of the present invention; and to FIGS. 4*b* and 4*c*, which are top views of a first and a second variant, respectively, of the combination heat dissipation structure according to the preferred embodiment of the present invention. As shown, the combination heat dissipation structure of the present invention includes a vapor chamber 3, and at least one heat pipe 4.

The vapor chamber 3 is formed by closing an upper plate member 31 and a lower plate member 32 to each other, such that an airtight chamber 33 is defined in the vapor chamber 3 between the upper and the lower plate member 31, 32. The airtight chamber 33 is filled with a working fluid (not shown). Two opposing inner side surfaces of the upper plate member 31 and the lower plate member 32 that correspondingly face toward the airtight chamber 33 are provided with a first wick structure 311 and a second wick structure 321, respectively. The upper plate member 31 is provided with at least one through hole 312, which extends through the upper plate member 31 in a thickness direction thereof. Each through hole 312 has an upward (i.e. outward) protruded flange 313 extending along a rim of the through hole 312. The first wick structure 311 is so arranged that it is spread to a location closely adjacent to the through hole 312.

The through hole 312 communicates the airtight chamber 33 with an outer side of the vapor chamber 3 and is provided mainly for one heat pipe 4 to insert thereinto, such that the heat pipe 4 and the vapor chamber 3 are joined together. The inner side surface of the lower plate member 32 of the vapor chamber 3 forms a vaporizing zone in the vapor chamber 3 and has the above-mentioned second wick structure 321 and a plurality of annular elements 6 provided thereon.

The annular element 6 is a porous structure to provide capillary force to facilitate the working fluid in a liquid phase to flow back to the vaporizing zone in the vapor chamber 3. The annular element 6 has an upper end surface 61 and a lower end surface 62, and an axial bore 63. The axial bore 63 is formed on the annular element 6 to axially extend through the upper and the lower end surface 61, 62, such that the annular element 6 forms a hollow structure. The upper and the lower end surface 61, 62 of the annular element 6 are in contact with the first and the second wick structure 311, 321, respectively.

Please refer to FIG. 4*a*. In the case one single annular element 6 is provided corresponding to one through hole 312, the annular element 6 can be placed with its axial bore 63 being concentric or eccentric with the through hole 312. Further, the axial bore 63 of the annular element 6 has a bore size equal to or smaller than a hole size of the through hole 312, and the annular element 6 has an outer diameter larger than the hole size of the through hole 312. With these arrangements, portions or areas of the upper end surface 61 of the annular element 6 extended between a rim of the axial bore 63 and the thorough hole 312 may serve to support the heat pipe 4 that is perpendicularly inserted into the through hole 312.

Please refer to FIGS. 4*b* and 4*c*. In the case two or more annular elements 6 are placed corresponding to one through hole 311, the annular elements 6 may be placed to space from one another, as shown in FIG. 4*b*, or be placed to be tangential to one another, as shown in FIG. 4*c*. In the above two cases, portions or areas of the upper end surfaces 61 of the annular elements 6 that overlap the through hole 312 may serve to support the heat pipe 4 that is perpendicularly inserted into the through hole 312.

The heat pipe 4 has two ends, one of which is a closed end 41 and the other is an open end 42, and internally defines a heat pipe chamber 43 extending between the closed end 41 and the open end 42. The heat pipe chamber 43 is provided on its entire inner wall surface with a third wick structure 44. The open end 42 of the heat pipe 4 is correspondingly inserted into the through hole 312 formed on the vapor chamber 3 to enter the airtight chamber 33 defined in the vapor chamber 3, such that the heat pipe 4 is joined to the vapor chamber 3. When the heat pipe 4 and the vapor chamber 3 are assembled in the above-described manner, the heat pipe chamber 43 and the airtight chamber 33 are communicable with each other.

The open end 42 of the heat pipe 4 is in contact with an upper side of the first wick structure 311 in the airtight chamber 33 of the vapor chamber 3, and a lower side of the first wick structure 311 is in contact with the upper end surface 61 of the annular element 6. Therefore, the open end 42 of the heat pipe 4 extended into the airtight chamber 33 via the through hole 312 is axially supported on the upper end surface 61 of the annular element 6. That is, the open end 42 of the heat pipe 4 is axially interfered by the annular element 6, such that the heat pipe 4 can no longer axially move deeper into the airtight chamber 33 in the vapor chamber 3. With the annular element 6 that provides axial propping, locating, and supporting to the heat pipe 4 joined to the vapor chamber 3, the assembly of the heat pipe 4 and the vapor chamber 3 has an increased structural strength.

The working fluid vaporized in the airtight chamber 33 of the vapor chamber 3 is allowed to diffuse directly toward the heat pipe chamber 43 in the heat pipe 4, so that heat carried by the vaporized working fluid is dissipated into surrounding air at a location remote from the vapor chamber 3. Since the annular element 6 is located correspondingly to the open end 42 of the heat pipe 4, the working fluid condensed in the heat pipe chamber 43 can be directly guided by the annular element 6 to flow back to the second wick structure 321 provided in the vaporizing zone in the vapor chamber 3. With this arrangement, the path and the time for the condensed working fluid to flow from the heat pipe 4 back to the vaporizing zone are largely shortened, enabling the working fluid to flow back faster and allowing continuous and stable two-phase heat exchange of the working fluid between the liquid phase and the vapor phase thereof to avoid the occurrence of dry burning in the vapor chamber 3.

The first wick structure 311, the second wick structure 321, and the third wick structure 44 may be formed of a sintered powder material, a woven mesh, a grid structure, or a fibrous structure. Further, the first wick structure 311, the second wick structure 321, and the third wick structure 44 can be formed of the same or different wick structures.

The lower plate member 32 of the vapor chamber 3 includes a plurality of supporting posts upward protruded from a bottom inner side of the lower plate member 32. The supporting posts and the through holes 312 are arranged in a staggered manner. The annular element 6 can be fitted around one supporting post while overlapping one corresponding through hole 312.

In the present invention, the provision of the annular element 6 not only enables good control of the depth by which the heat pipe 4 can be axially inserted into the airtight chamber 33 from an outer side of the vapor chamber 3, but also provides good axial supporting and locating of the heat pipe 4 and increases the structural strength of the combined heat pipe 4 and vapor chamber 3.

Further, the annular element 6 in the present invention serially connects the first wick structure 311, the second wick structure 321, and the third wick structure 44 which are provided in the vapor chamber 3 and the heat pipe 4 for storing working fluid and facilitating the working fluid to flow back from the heat pipe 4 to the vapor chamber 3. By providing the annular element 6, it is able to largely shorten the path and the time for the condensed working fluid in the heat pipe chamber 43 to flow from the heat pipe 4 through the annular element 6 back to the second wick structure 321 in the vaporizing zone of the vapor chamber 3. Therefore, the two-phase heat exchange between the heat pipe 4 and the vapor chamber 3 can occur continuously to avoid the situation of dry burning in the vaporizing zone of the vapor chamber 3 and maintain upgraded heat exchange efficiency.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A combination heat dissipation structure comprising:

a vapor chamber having an upper plate member and a lower plate member, which are closed to each other to define an airtight chamber between them, and the airtight chamber being filled with a working fluid; two opposing inner side surfaces of the upper plate member and the lower plate member that correspondingly face toward the airtight chamber being provided with a first wick structure and a second wick structure, respectively; and the upper plate member being provided with at least one through hole, which extends through the upper plate member in a thickness direction thereof and is communicable with the airtight chamber;

at least one heat pipe internally defining a heat pipe chamber that is communicable with the airtight chamber; the heat pipe having two ends, one of which is a closed end and the other is an open end; and the open end of the heat pipe being correspondingly inserted into the through hole to enter the airtight chamber of the vapor chamber and being in direct contact with the first wick structure; and at least one annular element being provided in the airtight chamber at a location corresponding to the through hole; the annular element having an upper and a lower end surface, which are in contact with the first wick structure and the second wick structure, respectively; the open end of the heat pipe inserted into the airtight chamber being axially propped, located and supported by the annular element, such that the vapor chamber and the heat pipe joined together can have an enhanced overall structural strength; and the annular element being able to guide the working fluid condensed in the heat pipe to directly and quickly flow back to the second wick structure in the vapor chamber, such that the path and the time for the working fluid to flow from the heat pipe back to the vapor chamber is shortened to enable upgraded two-phase heat exchange efficiency of the vapor chamber.

2. The combination heat dissipation structure as claimed in claim 1, wherein each through hole formed on the vapor chamber includes an axially outward and upward protruded flange.

3. The combination heat dissipation structure as claimed in claim 1, wherein the heat pipe chamber is provided on its entire inner wall surface with a third wick structure.

4. The combination heat dissipation structure as claimed in claim 3, wherein the first, the second, and the third wick structure are formed of a sintered powder material.

5. The combination heat dissipation structure as claimed in claim 1, wherein the annular element has an upper end surface and a lower end surface and an axial bore; and the axial bore being formed on the annular element to axially extend through the upper and the lower end surface, such that the annular element forms a hollow structure.

6. The combination heat dissipation structure as claimed in claim 5, wherein the annular element is located corresponding to the through hole and is concentric with the through hole; the axial bore of the annular element having a bore size smaller than a hole size of the through hole; and the annular element having an outer diameter larger than the hole size of the through hole.

7. The combination heat dissipation structure as claimed in claim 5, wherein there is a plurality of annular elements located corresponding to the same one through hole, and the upper end surfaces of all the annular elements overlapping the through hole.

8. The combination heat dissipation structure as claimed in claim 1, wherein the annular element is a porous structure.

9. The combination heat dissipation structure as claimed in claim 5, wherein the annular element is a porous structure.

10. The combination heat dissipation structure as claimed in claim 6, wherein the annular element is a porous structure.

11. The combination heat dissipation structure as claimed in claim 7, wherein the annular element is a porous structure.

* * * * *